US009046310B2

(12) United States Patent
Joensen et al.

(10) Patent No.: US 9,046,310 B2
(45) Date of Patent: Jun. 2, 2015

(54) PLATE HEAT EXCHANGER

(75) Inventors: Hjalmar Joensen, Vanloese (DK); Göran Paulsson, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 656 days.

(21) Appl. No.: 13/059,648

(22) PCT Filed: Aug. 24, 2009

(86) PCT No.: PCT/SE2009/050946

§ 371 (c)(1),
(2), (4) Date: Jun. 24, 2011

(87) PCT Pub. No.: WO2010/036183

PCT Pub. Date: Apr. 1, 2010

(65) Prior Publication Data

US 2011/0247797 A1 Oct. 13, 2011

(30) Foreign Application Priority Data

Sep. 23, 2008 (SE) ..... 0850020

(51) Int. Cl.
*F28F 3/08* (2006.01)
*F28D 9/00* (2006.01)

(52) U.S. Cl.
CPC ..... *F28F 3/083* (2013.01); *F28D 9/005* (2013.01); *F28F 3/086* (2013.01); *F28F 2255/143* (2013.01); *F28F 2225/08* (2013.01)

(58) Field of Classification Search
CPC ..... F28F 3/083; F28F 3/086; F28D 9/005
USPC ..... 165/78, 167, 906, 178
See application file for complete search history.

(56) References Cited

U.S. PATENT DOCUMENTS 2,379,671 A 7/1945 Wetherby-Williams
2,639,126 A * 5/1953 Newhall ..... 165/78

(Continued)

FOREIGN PATENT DOCUMENTS

CN 1202236 12/1998
CN 101151500 3/2008

(Continued)

OTHER PUBLICATIONS

Office Action for Chinese Patent Application No. 200980138125.8 dated Nov. 13, 2012 in English.

(Continued)

*Primary Examiner* — Mohammad M Ali
*Assistant Examiner* — Raheena Rehman
(74) *Attorney, Agent, or Firm* — Buchanan Ingersoll & Rooney PC

(57) ABSTRACT

The invention relates to a plate heat exchanger for treatment of a medium, comprising a number of compression-molded heat exchanger plates, which are successively provided in a plate package and which form first plate interspaces and second plate interspaces, wherein the first plate interspaces and the second plate interspaces are provided in an alternating order in the plate package, where the inlet and outlets of the heat exchanger plate located in a center portion of the plate heat exchanger, and where the plate package is arranged between end plates on each side of the plate package, where at least one of the end plates are provided with connections in a center portion of the at least one end plate and that the location of the connections on the at least one end plate correspond to the location of the inlet and outlets of the heat exchanger plate.

11 Claims, 7 Drawing Sheets

(56) References Cited

U.S. PATENT DOCUMENTS

| | | | | | |
|---|---|---|---|---|---|
| 2,677,531 | A | | 5/1954 | Hock et al. | |
| 3,150,028 | A | | 9/1964 | Wennerberg | |
| 3,448,796 | A | * | 6/1969 | Usher | 165/78 |
| 3,511,311 | A | * | 5/1970 | Pedersen | 165/78 |
| 4,291,752 | A | * | 9/1981 | Bridgnell | 165/81 |
| 4,377,025 | A | * | 3/1983 | Masai et al. | 29/434 |
| 4,763,488 | A | | 8/1988 | Johnston | |
| 5,333,683 | A | | 8/1994 | Arriulou et al. | |
| 5,462,112 | A | * | 10/1995 | Johansson | 165/167 |
| 5,787,974 | A | | 8/1998 | Pennington | |
| 6,536,511 | B1 | | 3/2003 | Nilsson et al. | |
| 6,899,163 | B2 | * | 5/2005 | Finch et al. | 165/67 |
| 7,195,057 | B2 | * | 3/2007 | Blomgren | 165/81 |
| 2002/0129926 | A1 | | 9/2002 | Yamaguchi | |

FOREIGN PATENT DOCUMENTS

| | | | | |
|---|---|---|---|---|
| DE | 199405012 | U1 | | 6/1994 |
| EP | 1085286 | A1 | | 3/2001 |
| EP | 1811258 | A2 | | 7/2007 |
| GB | 1240039 | A | | 7/1971 |
| JP | 55-60188 | | | 5/1980 |
| JP | 5-196389 | | | 8/1993 |
| JP | 05-196389 | | | 8/1993 |
| JP | 05196389 | A | * | 8/1993 |
| JP | 3237162 | | | 12/2001 |
| KR | 10-2007-0118610 | A | | 12/2007 |
| WO | WO9723759 | A1 | | 7/1997 |
| WO | WO9739301 | A1 | | 10/1997 |
| WO | WO9966279 | A2 | | 12/1999 |
| WO | WO0190671 | A1 | | 11/2001 |
| WO | 2004/070302 | A1 | | 8/2004 |
| WO | WO2006043864 | A1 | | 4/2006 |
| WO | WO 2006104443 | A1 | * | 10/2006 |
| WO | WO2006104443 | A8 | | 10/2006 |

OTHER PUBLICATIONS

First Office Action for CN Application No. 200980138125.8 issued May 28, 2012 with English translation.

English language Translation of Preliminary Rejection issued by Korean Intellectual Property Office on Oct. 12, 2012 in Korean Patent Application No. 10-2011-7006562. (3 pages).

Office Action for Japanese Application No. 2011-523775 dated Sep. 18, 2012, with English translation.

Form PCT/ISA/237 for PCT/SE2009/050946, 5 pages.

* cited by examiner

100

13
45
3
6
11
12
HVVin
11
14
19
1
2
36
4
3

PLATE HEAT EXCHANGER

AREA OF INVENTION

The present invention refers generally to plate heat exchangers allowing a heat transfer between two fluids at different temperature for various purposes. Specifically, the invention relates to a plate heat exchanger being configured so that the ports of the heat exchanger plates are gathered in a centre portion of the heat exchanger plate and having a end plate adapted to the location of the ports.

BACKGROUND OF INVENTION

The present invention refers generally to a plate heat exchanger for distillation of a medium, e.g. desalination of salt-containing water, such as seawater. For treatment of a medium the plate heat exchanger comprises a number of compression-molded heat exchanger plates, which are successively provided in a plate package and which form first plate interspaces for the medium and second plate interspaces, wherein the first plate interspaces and the second plate interspaces are provided in an alternating order in the plate package.

Traditionally the plate heat exchanger or desalination apparatus comprise several separate plate heat exchangers since the all steps of desalination could not be performed in a single standard plate heat exchanger. To simplify the equipment or apparatus for desalination of seawater a new kind of plate heat exchanger has been developed, which described in EP-A1-1 864 069. It discloses a plate heat exchanger configured as a desalination plant comprising a plate package, where the several ports of the heat exchanger plates are located in centre portion of the heat exchanger plates. In traditional plate heat exchangers the ports are located in the corners of the heat exchanger plate, close to the tie bolts which takes up the stress. In EP-A1-1 864 069 having the ports are located a centre portion, whereby another distribution of the mechanical stress, the end plate need to be configured differently to take the stress. Further having several of the main ports of the heat exchanger plate in a rather limit space of the heat exchanger plate and thereby also the corresponding port outlets on the end plate in a limit space of the end plate makes the location of the connections coupled to the port outlets rather tight with the standard solution of the connections as shown in EP-A1-1 864 069.

DISCLOSURE OF INVENTION

The object of the invention is to provide an improved plate heat exchanger having an end plate, which is adapted for a heat exchanger plate having the ports located in a centre portion of the heat exchanger plate.

This object is achieved by the plate heat exchanger initially defined, which is characterized in that at least one of the end plates are provided with connections in a centre portion of the at least one end plate and that the location of the connections on the at least one end plate correspond to the location of the inlet and outlets of the heat exchanger plate.

According to another aspect of the invention a centre axis extends substantially centrally between two side edges of each heat exchanger plate and substantially vertically when the plate package is disposed in a normal position of use, and that the ports of the heat exchanger plate are located along the centre axis.

According to yet another aspect of the invention at least one connection of the end plate is arranged in centre portion of end plate along a vertical axis corresponding to the centre axis of heat exchanger plate.

According to a further aspect of the invention at least one connection of the end plate is arranged in a connecting part on the end plate, where the connecting part extends along a vertical axis of the end plate corresponding to the centre axis of heat exchanger plate, and that the connecting part projects from the end plate in a direction away from the plate package.

According to yet further aspect of the invention the connecting part projects equilaterally along its longitudinal extension to form a substantial triangular shape having the base towards the end plate. At least one connection is arranged on each of the sides of the connecting part that are directed away from the end plate of the plate heat exchanger.

According to yet further aspect of the invention the connecting part is arranged as a reinforcement part of the end plate to withstand the stress that the end plate is exposed to during operation. The connecting part can be an integrated part of the end plate or it can be mounted separately onto the end plate by any suitable fastening means.

According to yet further aspect of the invention the end plate can be provided with reinforcement portions in stress-exposed parts, where the reinforcement portions are provided as added thickness of the end plate, i.e. the thickness of the end plate vary depending on the stress so that areas exposed to more stress are thicker and other areas are thinner.

Further aspects of the invention are defined in the dependent claims.

BRIEF DESCRIPTION OF THE DRAWINGS

The present invention is now to be explained more closely by means of a description of various embodiments and with reference to the drawings attached hereto.

DETAILED DESCRIPTION OF EMBODIMENTS

Heat exchangers are used for transferring heat between two fluids separated by a solid body. Heat exchangers can be of several types, the most common are spiral heat exchangers, tubular heat exchangers and plate heat exchangers. Plate heat exchangers are used for transferring heat between a hot and a cold fluid that are flowing in alternate flow passages formed between a set of heat exchanger plates. The arrangement of heat exchanger plates defined above is enclosed between end plates that are relatively thicker than the heat exchanger plates. The inner surface of each end plate faces the heat transfer plates.

Figure 1:
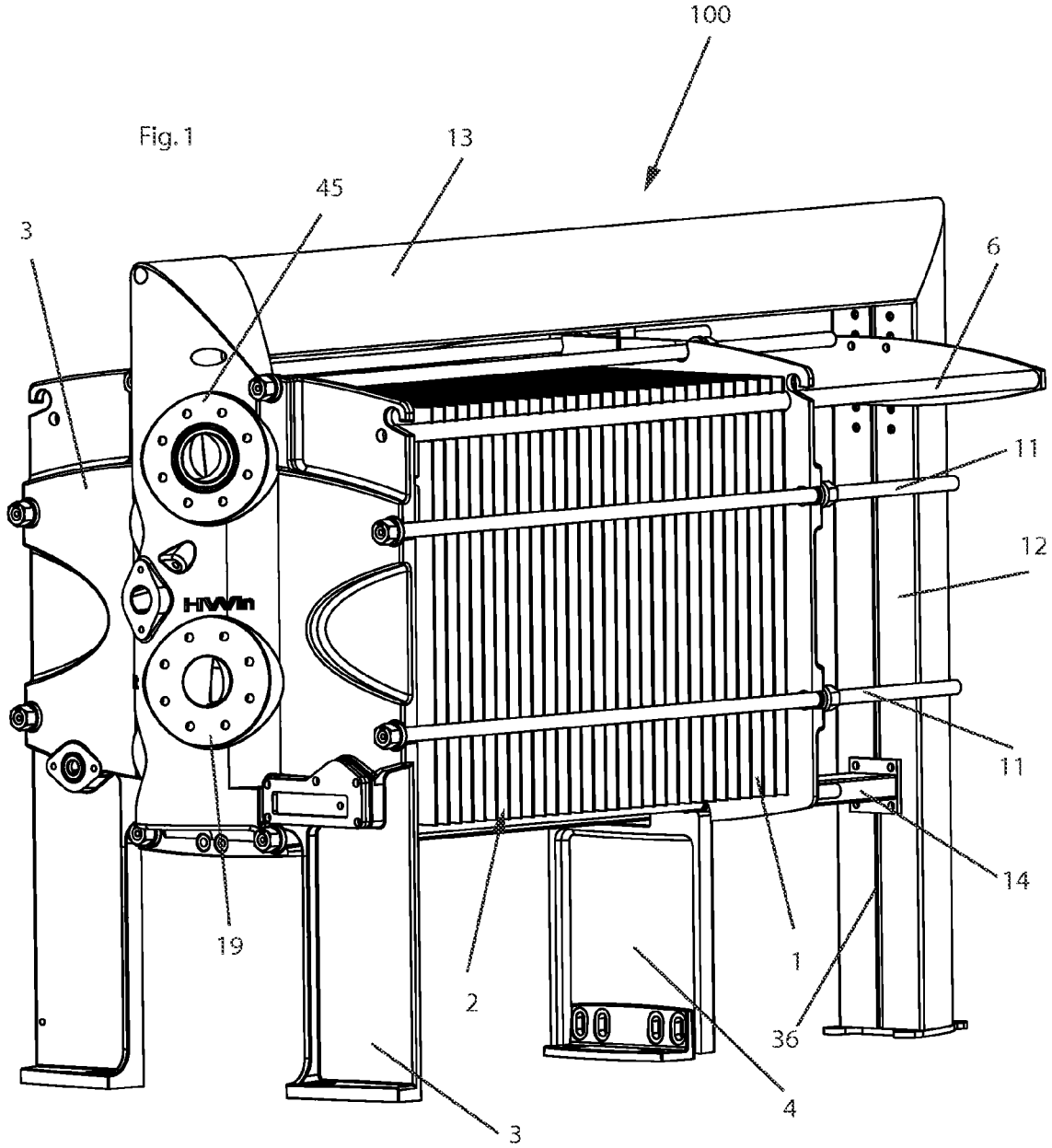
FIGS. 1-2 disclose perspective views of a plate heat exchanger according to an embodiment of the invention.
Figure 2:
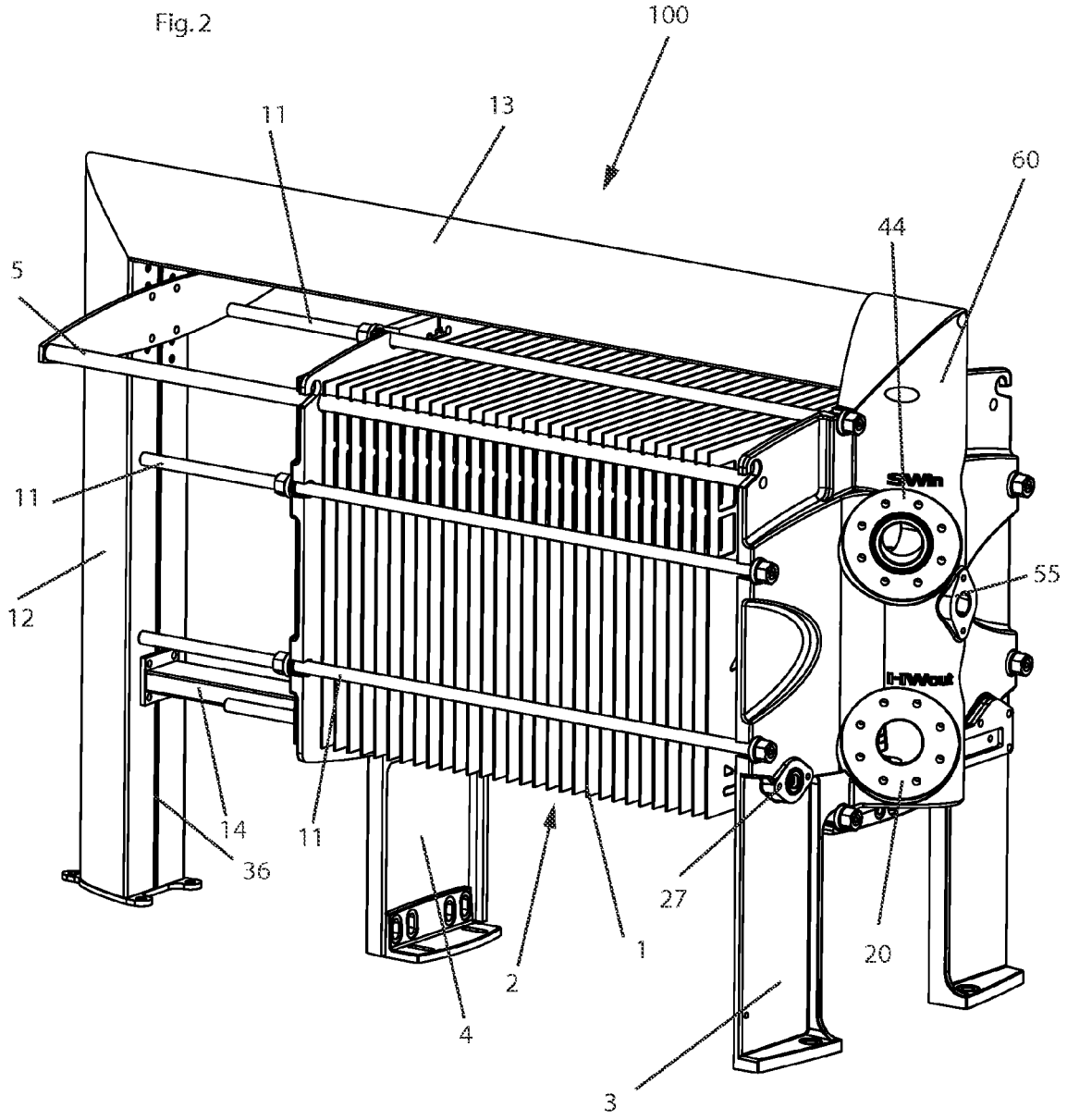
Figure 3:
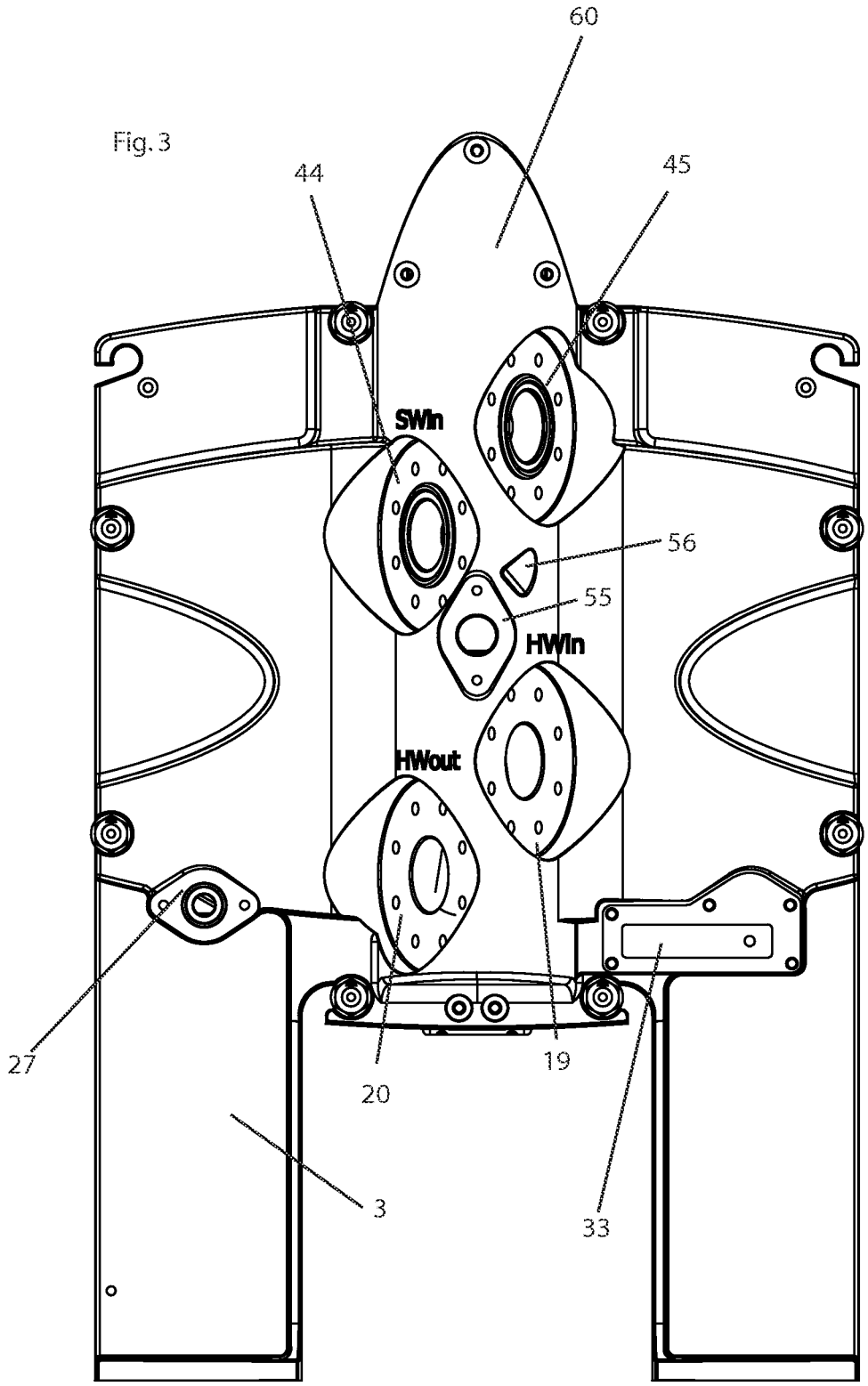
FIG. 3 discloses a front view of a first end plate in a plate heat exchanger according to an embodiment of the invention.
Figure 4:
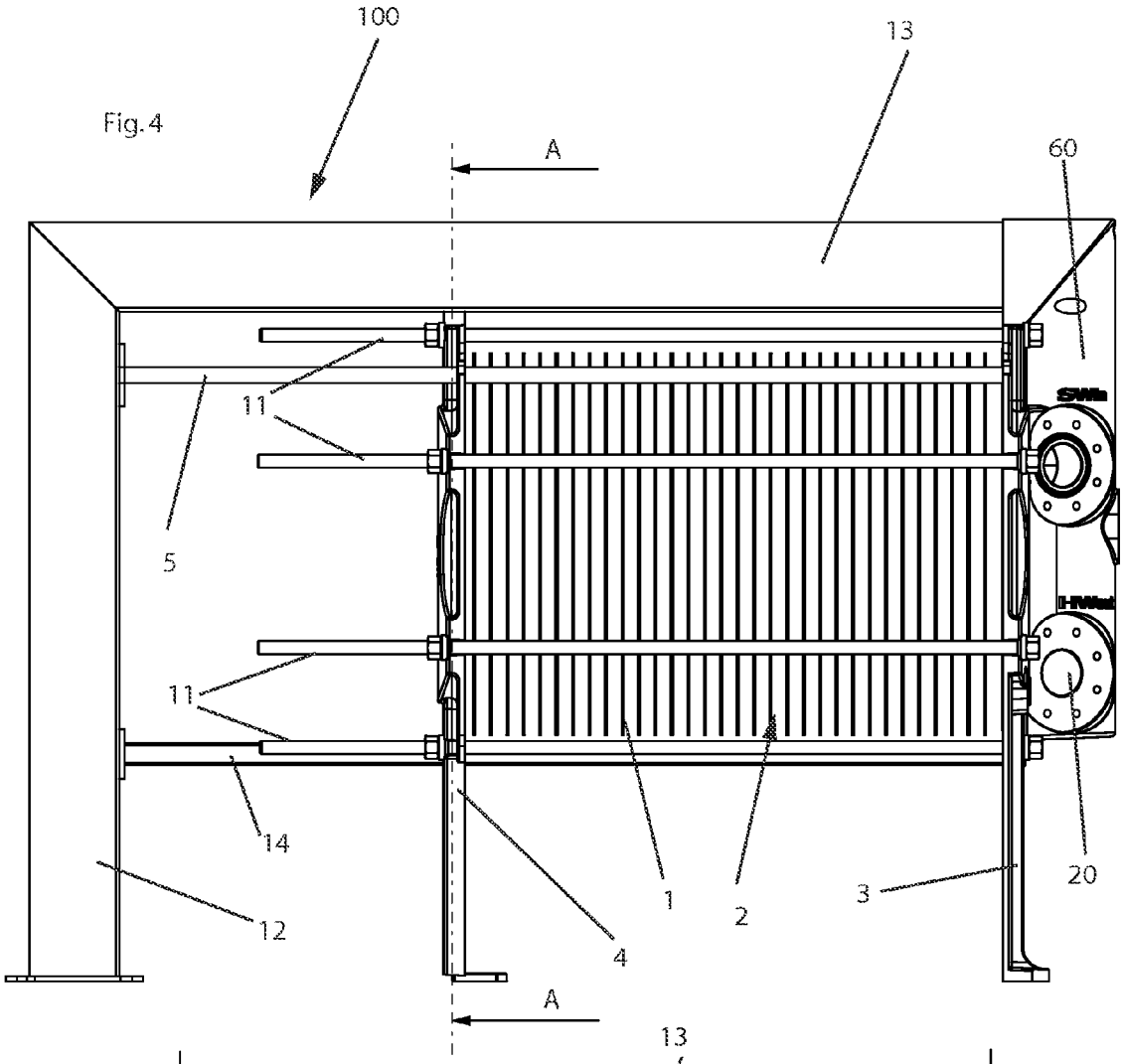
FIG. 4 discloses a side view of a plate heat exchanger according to an embodiment of the invention.

FIGS. 1-2 disclose a plate heat exchanger 100 for treatment of a medium, typically used for an application with respect to desalination of seawater, i.e. a fresh water generator. The plate heat exchanger 100 comprises a large number of compression-molded heat exchanger plates 1, which are provided in parallel to each other and successively in such a way that they form a plate package 2. The plate package 2 is provided between a first end plate 3, also called frame plate, and a second end plate 4, also called pressure plate. Between the heat exchanger plates 1, first plate interspaces and second plate interspaces are formed.

The first plate interspaces and the second plate interspaces are provided in an alternating order in the plate package 2 in such a way that substantially each first plate interspace is surrounded by two second plate interspaces, and substantially each second plate interspace is surrounded by two first plate interspaces. Different sections in the plate package 2 are delimited from each other by means of gaskets in each plate interspace. The gasket, which is preferably made of an elastic material, e.g. rubber material, is disposed in a groove which extends along the periphery of the constituent heat exchanger plates 1 and around ports. The gasket may possibly comprise a metal or be surrounded by a second material, e.g. metal, PTFE, etc.

Figure 6:
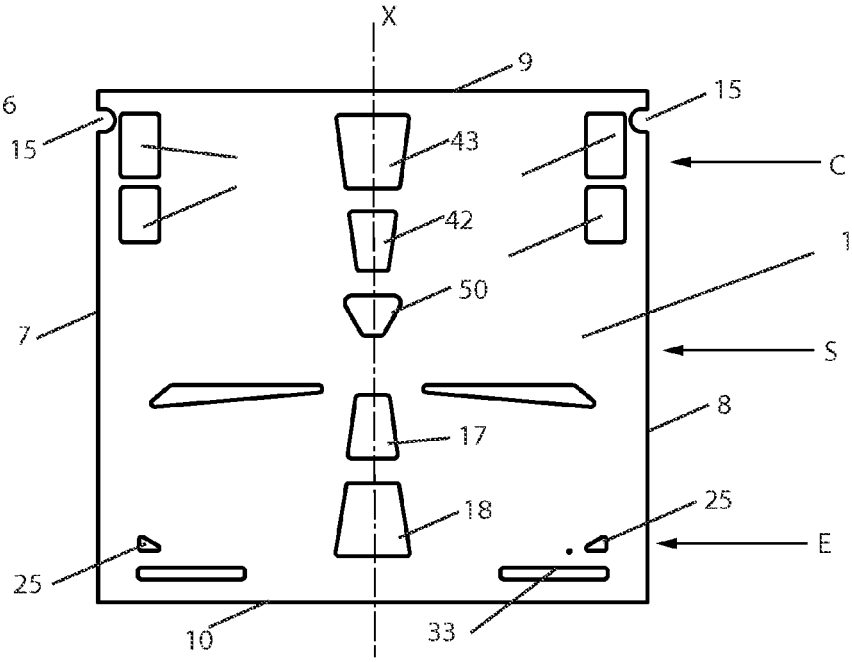
FIG. 6 discloses a front view perspective view of a heat exchanger plate used in a plate heat exchanger according to an embodiment of the invention.

As shown in FIG. 6 each heat exchanger plate 1 has two opposite substantially parallel side edges 7, 8, an upper edge 9 and a lower edge 10. A centre axis X extends substantially centrally between the two side edges 7 and 8, and substantially vertically when the plate package 2 is located in a normal position of use.

As shown in FIG. 1, the plate package 2, i.e. the heat exchanger plates 1 and the gaskets (not shown) provided there between, is kept together between the end plates 3 and 4 by means of threaded tie bolts 11 in a manner known per se. The tie bolts 11 extends from the first end plate 3 and passing through holes or recesses in the edge portions of the second end plate 4. Each tie bolt 11 has a bolt head means at one of its ends, possibly situated at the outside (or integrated in) of the first end plate 3, and carries nuts on its threaded part, possibly situated at the outside (or integrated in) of the end plate 4.

The heat exchanger plates 1 are arranged hanging on two carrying bolts 5, 6 that substantially extend between the first end plate 3 and a support column 12. The heat exchanger plate 1 is provided with cut-in portions 15 (see FIG. 6) provided on each of the side edges 7 and 8. The first end plate 3 is connected to the support column 12 by a carrying bar 13, which in one end is fixedly attached to an upper end of the first end plate 3 and in the opposite end fixedly attached to an upper end of the support column 12. The second end plate 4, which is movable along the carrying bar 13, is used to press the heat exchanger plates 1 together to form the plate package 2. A guide bar 14, that guides the heat exchanger plates 1 in their lower end, connects a lower portion of the support column 12 with a lower part of the first end plate 3.

The heat exchanger plate 1 discussed above includes in a manner known per se a corrugation or pattern for increasing the heat transfer and a number of port holes for forming a corresponding number of port channels extending through the plate package and being in connection with the flow channels formed between the heat exchanger plates 1.

Figure 9:
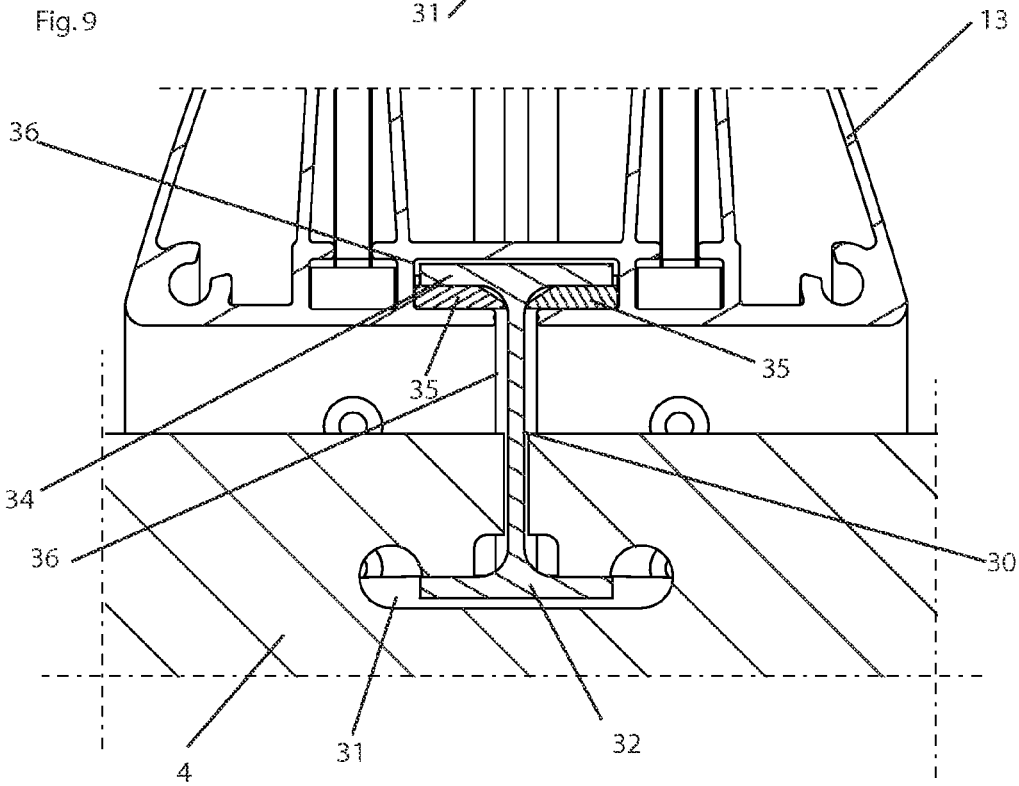

The end plate 3 is suitably provided with a number of port outlets or connections 27, 33, 19, 20, 44, 45, 55 and 56 corresponding to ports 25, 33, 17, 18, 42, 43 and 50 of the heat exchanger plate 1. Due to the specific duties of the plate heat exchanger 100, the plate package 2 encloses an evaporation section E, a separation section S and a condensation section C (see FIG. 9). The evaporation section E is arranged to permit evaporation of at least a part of the medium flowing through the first plate interspaces. The separation section S is arranged to separate non-evaporated liquid from the evaporated part of the medium. The condensation section C is arranged to condense the evaporated part flowing through the first plate interspaces. The centre axis X extends substantially centrally through the evaporation section E, the separation section S and the condensation section C. As can be seen in FIG. 9, the evaporation section E is located at a lowermost position, the condensation section C at an uppermost position and the separation section S between the evaporation section E and the condensation section C, when the plate heat exchanger 100 is in the normal position of use.

The several functions, i.e. evaporation, condensation and separation, of the plate heat exchanger 100 necessitate more connections on the end plate or frame 3 than in a traditional plate heat exchanger. Especially the ports 17, 18, 42, 43 and 50 along the centre axis X, which is a rather limit space on the end plate 3, demands an innovative solution. For that reason the centre portion, extending the lower end to the upper end, of the end plate 3 is formed with a connecting or projecting part 60. The connecting part 60 of the end plate 3, which extends equilaterally or from a main surface of the end plate 3, is a substantially regular triangle or isosceles triangle shaped with the base towards the end plate 3. On the sides or flanks of the triangular shaped connecting part 60 are arranged with connections 19-20 and 44-45, which can be arranged relatively narrow, since they are arranged alternately on the two sides of the substantial triangle 60. Thereby standard connections can be used even though that a relatively short or compact heat exchanger plate 1 is used. This would not be possible a flat end plate 3 had used since the space would not be enough for the standard connections when having five connections, could be more also, arranged along a vertical axis in the centre of the end plate and when having a relatively short heat exchanger plate 1. The end plate 3 is further provided yet another number of connections, e.g. another two connections 55, 56 on the projecting part 60 and connections 27, 33 on other part of the end plate 3. Each of the connections of the end plate 3 is connected to a corresponding port on the heat exchanger plate 1.

The end plate 3 is further tailor-made to include reinforcement on those portions of the end plate 3, which are exposed to additional or increased stress. This is accomplished by adding material or adding thickness to the end plate 3 only on those parts of the end plate 3 being exposed to stress, e.g. the mounting locations of the tie bolts 11 and the connections. By tailor-made the design of the end plate 3 to withstand the different stress in the different parts of the end plate 3, instead of over-dimensioning the entire end plate 3, substantial savings can be made in reduced need of material, thus also costs.

To achieve a first end plate 3 having varied thickness and a projecting connecting 60 the end plate 3 is preferably made by casting, molding, founding or any other similar and suitable manufacturing process.

Figure 7:
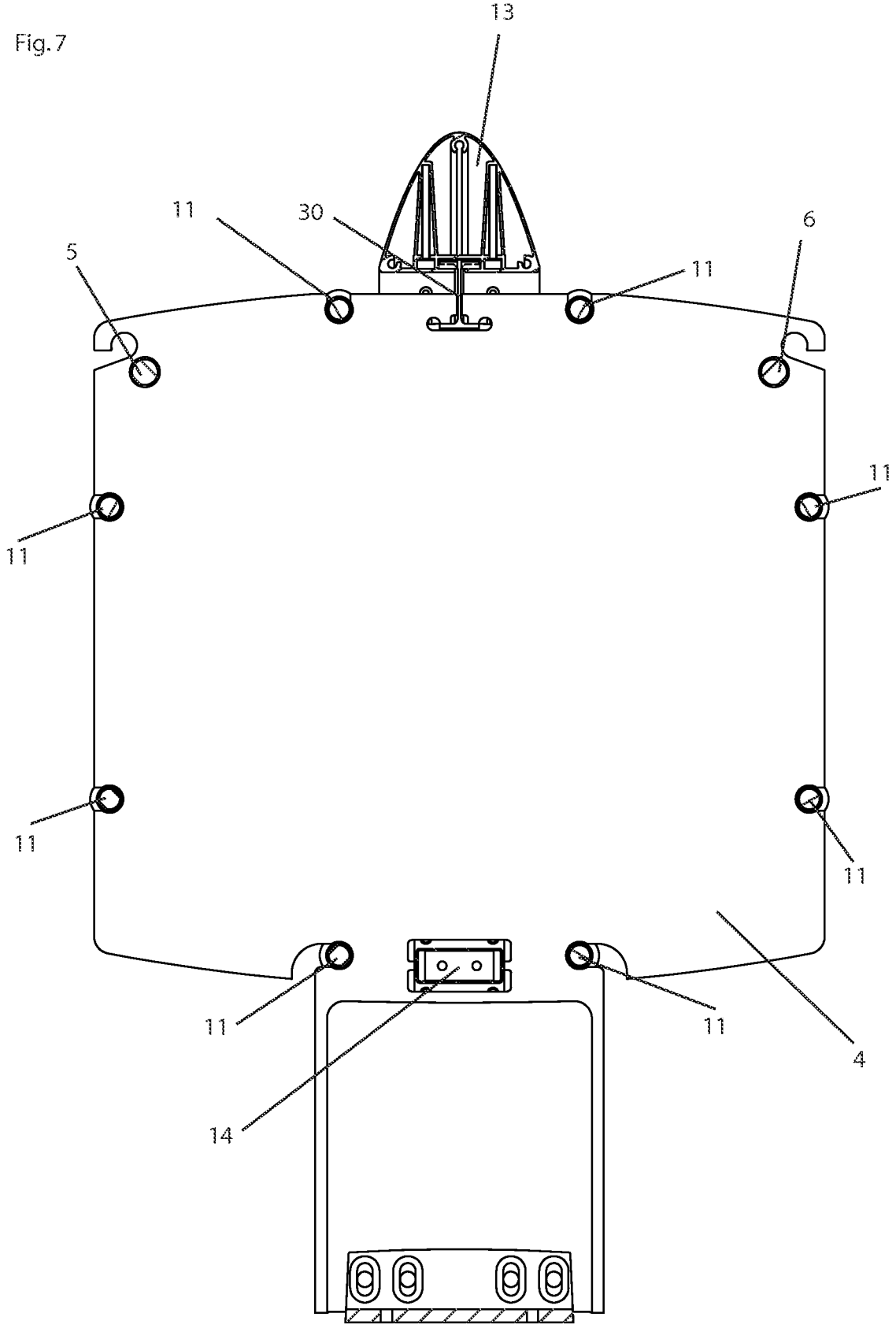
FIG. 7 discloses a front view of a second end plate in a plate heat exchanger according to an embodiment of the invention as seen from the line A-A of FIG. 4.

In FIG. 7 is shown the second end plate 4 and a cross-section of the carrying bar 13. The end plate 4 is arranged hanging on the carrying bar 13. In prior art plate heat exchangers, both the heat exchanger plates and the moveable end plate are arranged hanging on a T-profile arranged on the underside of the carrying bar. As the heat exchanger plates 1 in the present invention are arranged hanging on carrying bolts 5, 6 the need for T-profile arranged along the entire underside of the carrying bar is small, but only an arrangement 30 for hanging the second end plate 4 is needed. In FIG. 7 this arrangement 30 is formed as short profile, e.g. IPF profile, which movably connects the end plate 4 with the carrying bar 13. The length of the hanging profile 30 along the longitudinal direction of the carrying bar 13 corresponds to the thickness of the end plate 4.

Figure 8:
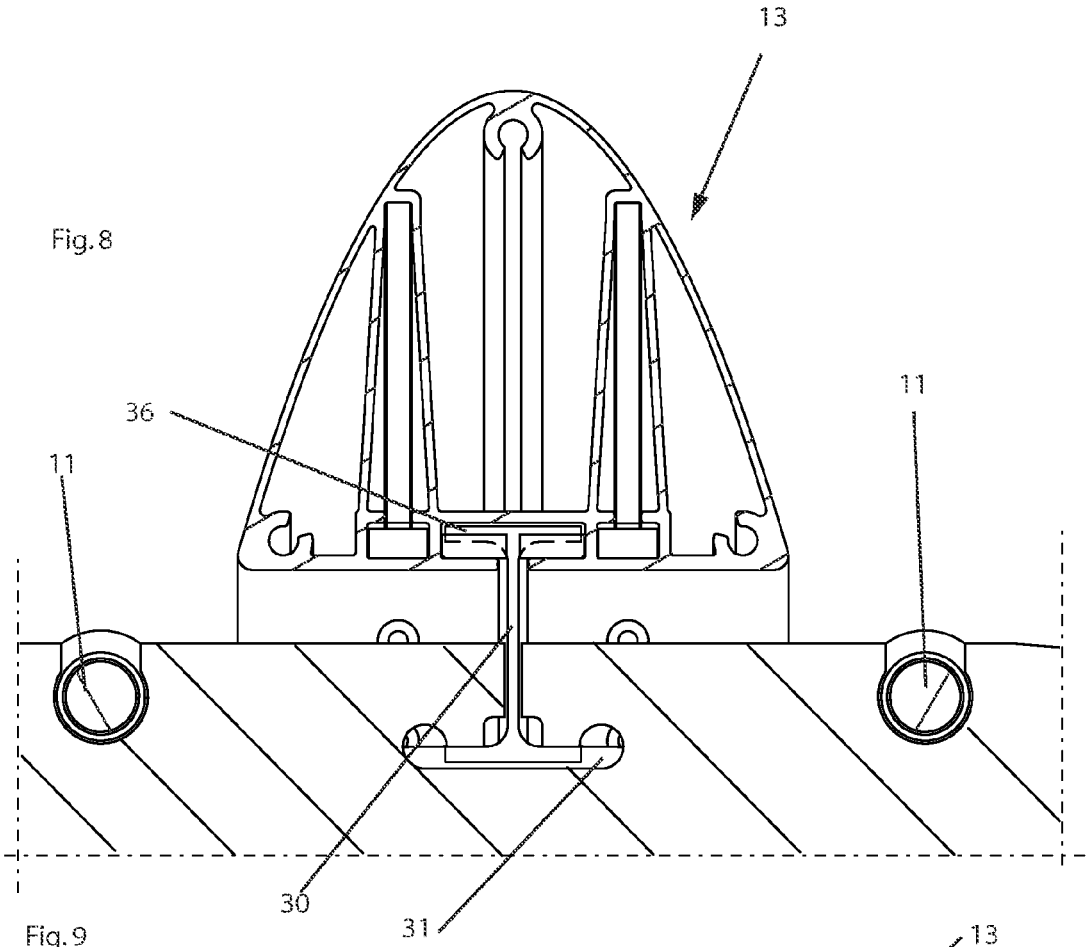
FIGS. 8-9 are cross sectional views of a carrying bar of a plate heat exchanger according to an embodiment of the invention and partial detailed views of the second end plate and a hanging arrangement as seen from the line A-A of FIG. 4.

In FIGS. 8 and 9 a partial, detailed cross-section of the hanging profile 30, the carrying bar 13 and the end plate 4 is shown. The one portion of the hanging profile 30 is received in cut-out portion 31 in an upper end of the second end plate 4, and can be attached to the second end plate 4 by using various attachment means known in the art, e.g., screws, bolts, welding, etc. The shape of the cut-out portion 31 corresponds to a lower portion 32 of the hanging profile 30, and is substantially formed as a T turned upside down. Similarly another portion of the hanging profile 30 is movably received in cut-out portion 36 in the lower part of the carrying bar 13. The shape of the cut-out portion 36 of the carrying bar 13 corresponds to an upper portion 34 of the hanging profile 30, and is substantially formed as a T. The upper portion 34 of the hanging profile 30 is provided with plastic bearings 35 on each of the "legs" of the T-shape so that the hanging profile 30 can slide on the bearings 35 when it is received in the cut-out portion 36 of the carrying bar 13. The corresponding surface of the cut-out portion of the carrying bar 13 upon which the plastic bearings 35 slide is preferably made of a low friction material, such as an anodized aluminum profile.

Figure 10:
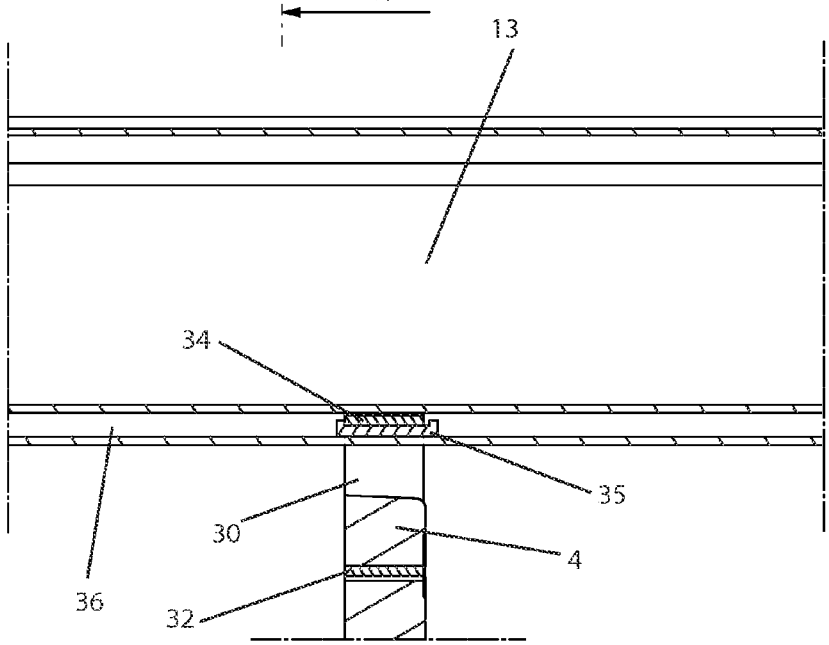
FIG. 10 is partial detailed side of the carrying bar of the plate heat exchanger according to an embodiment of the invention and the second end plate.
Figure 5:
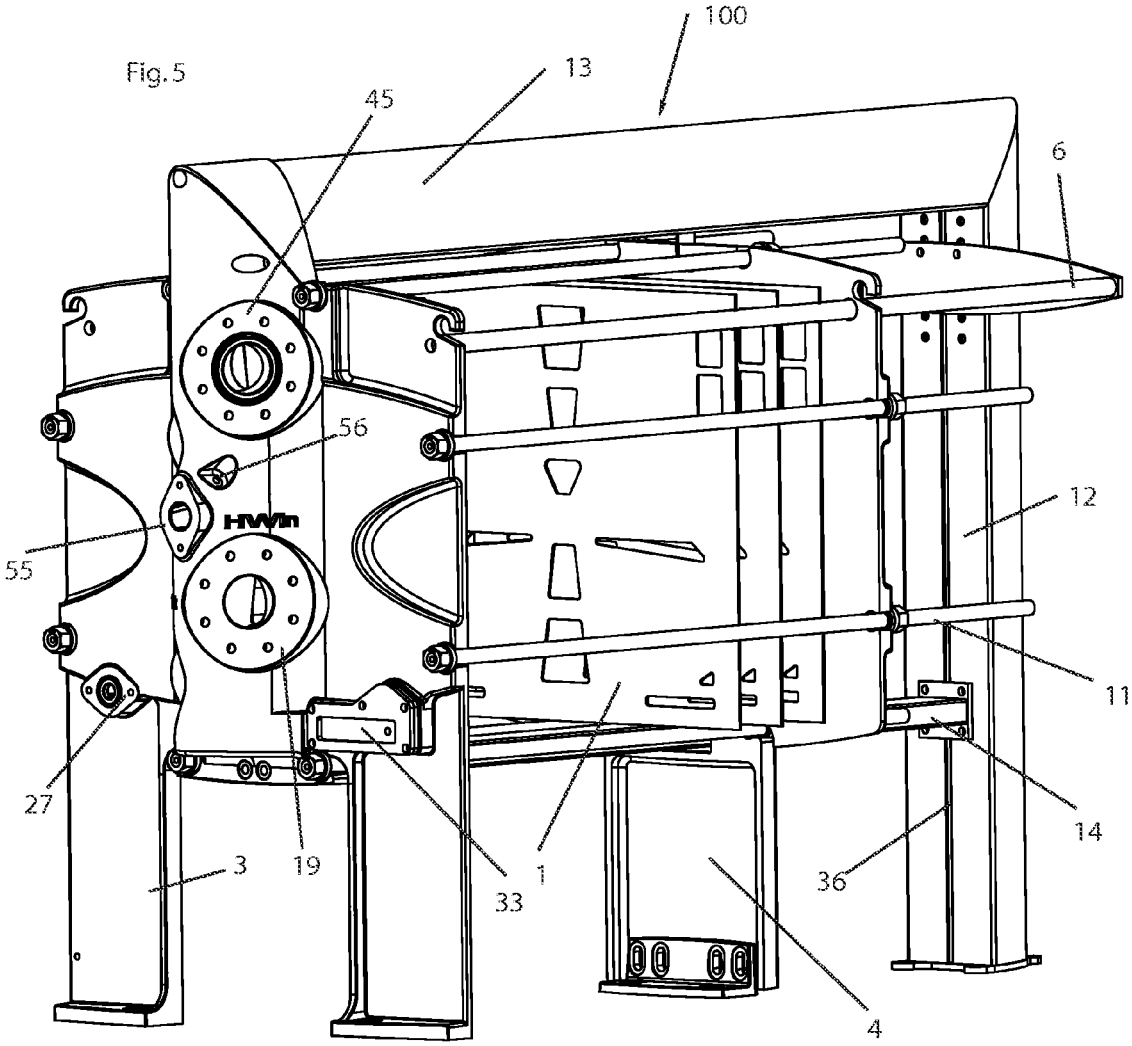
FIG. 5 discloses a perspective view of a plate heat exchanger according to an embodiment of the invention, where the plate heat exchanger is open.

In FIG. 10 a partial detailed cross-section along the longitudinal direction of the carrying bar 13 is shown. From FIG. 10 it is clear that the plastic bearings 35 have substantially the same length as the hanging profile 30. The cut-out portion 36 extends along substantially the entire length of the carrying bar 13, and in FIG. 10 a part of the channel formed by the cut-out portion 36 in the lower part of the carrying bar 13 and in which the hanging profile 30 run or slides is shown. From the outside the cut-out portion 36 appears as a slits on underside of the carrying bar 13. The support column 12 and the carrying bar 13 have identical cross-sections and in FIGS. 1, 2 and 5 a slits 36 is shown on the support column 12, which corresponds to the slits/cut-out portion 36 of the carrying bar 13.

The invention is not limited to the embodiments described above and shown on the drawings, but can be supplemented and modified in any manner within the scope of the invention as defined by the enclosed claims.

The invention claimed is:

1. A plate heat exchanger for treatment of a medium comprising a plurality of compression-molded heat exchanger plates, successively arranged in an axial direction to form a plate package including first plate interspaces and second plate interspaces, wherein the first plate interspaces and the second plate interspaces are in an alternating order in the plate package, wherein inlet and outlets of the heat exchanger plates are located in a centre portion of the plate heat exchanger, wherein the plate package is arranged between end plates, at least one of the end plates forming a portion of an exterior of the plate heat exchanger, the at least one end plate possessing side portions and a centre portion located between the side portions, the at least one end plate comprising a connecting part at the centre portion of the at least one end plate, the connecting part extending along a vertical axis of the at least one end plate corresponding to a center axis of the heat exchanger plates, the connecting part projecting away from the plate package in said axial direction relative to the side portions of the at least one end plate, more than two connections located in the projecting connecting part of the at least one end plate, each of the connections being connected to a corresponding one of the inlet and outlets of the heat exchanger plates, and the connecting part of the at least one end plate including a first face and a second face angled relative to each other, a first one of the connections lying along the first face, and a second one of the connections tying along the second face.

2. The plate heat exchanger according to claim 1, wherein a centre axis extends centrally between two side edges of each heat exchanger plate and vertically when the plate package is disposed in a normal position of use, and the inlets and outlets of the heat exchanger plate are located along the centre axis.

3. The plate heat exchanger according to claim 1, wherein the connecting part projects equilaterally along its longitudinal extension to form a triangular shape having a base towards the at least one end plate.

4. The plate heat exchanger according to claim 3, wherein at least one connection is arranged on each side of the connecting part.

5. The plate heat exchanger according to claim 1, wherein the connecting part is arranged as a reinforcement part of the end plate.

6. The plate heat exchanger according to claim 5, wherein the connecting part is an integrated part of the end plate.

7. The plate heat exchanger according to claim 1 or claim 2, wherein the at least one end plate has reinforcement portions in stress-exposed parts, and wherein the reinforcement portions are provided as added thickness of the end plate.

8. An end plate for use in a plate heat exchanger configured to treat a medium and comprising a plurality of compression-molded heat exchanger plates successively arranged in an axial direction between the end plate and an other end plate to form a plate package that includes first plate interspaces and second plate interspaces in an alternating order in the plate package, the heat exchanger plates including an inlet and outlets located in a centre portion of the plate heat exchanger, the end plate possessing side portions and a centre portion located between the side portions, the end plate comprising a connecting part at the centre portion of the end plate, the connecting part extending along a vertical axis of the end plate corresponding to a center axis of the heat exchanger plates, the connecting part projecting in said axial direction relative to the side portions of the end plate, the projecting connecting part of the end plate including at least three connections each configured to correspond to a corresponding one of the inlet and outlets, and the projecting connecting part of the end plate including a first face and a second face angled relative to each other, a first one of the connections lying along the first face, and a second one of the connections lying along the second face.

9. A plate heat exchanger comprising:

compression-molded heat exchanger plates arranged adjacent one another along an axial direction to form a plate package including first and second plate interspaces arranged in an alternating order;

each heat exchanger plate including at least three ports overlapping a longitudinal centerline of the heat exchanger plate;

a first end plate and a second end plate positioned on opposite ends of the plate package, the first end plate forming a portion of an exterior of the plate heat exchanger, the first end plate including at least three connections which each overlap a longitudinal centerline of the first end plate and which are each connected to a corresponding one of the ports of the heat exchanger plate positioned next to the first end plate;

wherein a central portion of the first end plate projects away from a remainder of the first end plate along the axial direction, and at least one of the connections lies along the central portion of the first end plate; and the central portion of the first end plate including a first face and a second face angled relative to each other, a first one of the connections lying along the first face, and a second one of the connections lying along the second face.

10. The plate heat exchanger of claim 9, wherein the central portion of the first end plate has a triangular shape, the first face forming a side of the triangle shape, and the second face forming another side of the triangle shape.

11. The plate heat exchanger of claim 9, wherein the central portion of the first end plate extends along an entirety of the longitudinal centerline of the first end plate.

* * * * *